United States Patent [19]

Alviar et al.

[11] Patent Number: 5,074,027

[45] Date of Patent: Dec. 24, 1991

[54] METHOD OF MAKING A SQUEEGEE

[75] Inventors: Christopher G. Alviar, Portland, Oreg.; Paul E. Furner, Logan, Utah; David R. Knaub, Portland, Oreg.; Terrence K. Jones, Portland, Oreg.; Sohrab Vossoughi, Portland, Oreg.

[73] Assignee: Hanco, Inc., Lake Oswego, Oreg.

[21] Appl. No.: 507,318

[22] Filed: Apr. 9, 1990

[51] Int. Cl.[5] ..... A47L 13/11

[52] U.S. Cl. ..... 29/525; 15/245

[58] Field of Search ..... 15/245, 250.36, 250.41; 29/428, 469, 525

[56] References Cited

U.S. PATENT DOCUMENTS 1,520,045 12/1924 Winiarski ..... 15/245

4,941,228 7/1990 Belanger et al. ..... 15/245

FOREIGN PATENT DOCUMENTS 288402 4/1928 United Kingdom ..... 15/245

*Primary Examiner*—Edward L. Roberts

*Attorney, Agent, or Firm*—Marger, Johnson, McCollom & Stolowitz, Inc.

[57] ABSTRACT

A squeegee has a handle consisting of a straight elongate cylindrical member having a pair of elongate blades mounted along one side, flush with one end of the handle and protruding beyond the opposite end. The blades each have a rigid base portion received in one of a pair of channels and a flexible distal portion protruding therefrom for wiping a surface. The blades are integrally formed in a shallow S-shaped cross section and the channels are formed with parallel curved sidewalls conforming to the curvature of a portion of the width of the blade.

8 Claims, 3 Drawing Sheets

METHOD OF MAKING A SQUEEGEE

BACKGROUND OF THE INVENTION

The invention relates to squeegees. Squeegees have long been used for cleaning surfaces and stripping the surfaces of free liquid and droplets. A conventional squeegee has a handle with a blade mounted at one end at a right angle to the handle, in a T-shaped configuration. This arrangement is clumsy to handle, difficult to use in corners and is hard to store when not in use.

SUMMARY OF THE INVENTION

The invention is an improved structure and method for making a squeegee. The squeegee structure comprises a straight elongate tubular or, preferably, cylindrical member, defining a handle having a first end and a second end, and one or preferably a pair of elongate blade members received in a groove or a pair of parallel, closely spaced-apart channels extending lengthwise from end to end of the tubular handle.

In a preferred embodiment of the squeegee structure, each blade member has a rigid base portion received in one of the channels and a flexible portion protruding therefrom for wiping a surface. Each blade member has a first end substantially aligned with the first end of the handle and a second end protruding lengthwise a predetermined distance, e.g., several inches, beyond the second end of the handle. Each blade member has a shallow S-shaped cross section and each channel has parallel curved sidewalls conforming to a curvature of the base portion of the blade member received therein.

The method of making a squeegee comprises forming the tubular member with a lengthwise extending groove or pair of channels, forming one or more unitary blades, and inserting one of the blades lengthwise into each groove or channel. The blade is sized to a predetermined length at least as great as the length of the tubular member and a width defining a base portion approximately equal in width to the depth of the groove and a flexible wiping portion of a predetermined width. The base portion is arranged to form an interference fit in the groove and is sufficiently rigid lengthwise that the blade remains substantially straight upon insertion into the groove.

The blade is preferably sized to a thickness close to the width of the groove and in a shallow S-shaped cross section and the groove is formed with parallel curved sidewalls conforming to the curvature of the base portion of the blade. The tubular member with lengthwise extending groove is preferably formed by extrusion of a rigid polymeric material, and its ends are enclosed by end caps formed with slots which align with the groove or channels. The unitary blade is preferably formed by coextrusion of a rigid polymeric material to form the rigid base portion and a soft polymeric material to form the flexible wiping portion.

The foregoing and other objects, features and advantages of the invention will become more readily apparent from the following detailed description of a preferred embodiment which proceeds with reference to the drawings.

DETAILED DESCRIPTION

Figure 1:
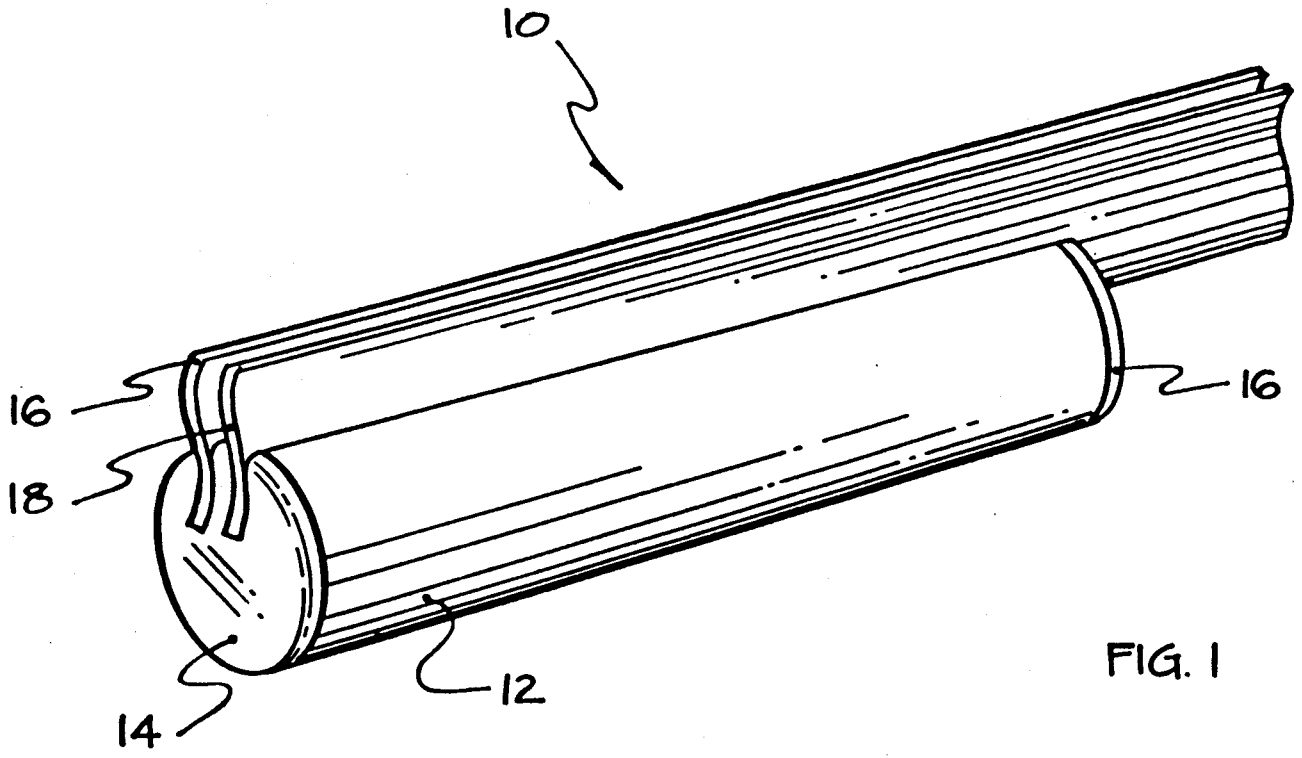
FIG. 1 is a perspective view of a squeegee in accordance with the invention.

Referring to FIG. 1, a squeegee 10 comprises an elongate tubular, cylindrical member defining a handle 12 having a first end and a second end each enclosed by end caps 14, 16. A pair of spaced, unitary elongate blades 18 extend lengthwise of the handle.

The blades have a first end substantially aligned with the first end of the handle and a second end protruding lengthwise a predetermined distance beyond the second end of the handle. The blade members are of equal width and length, each having a predetermined width exposed outside the channels, and are mounted such that the blades have substantially aligned distal edges.

Figure 2:
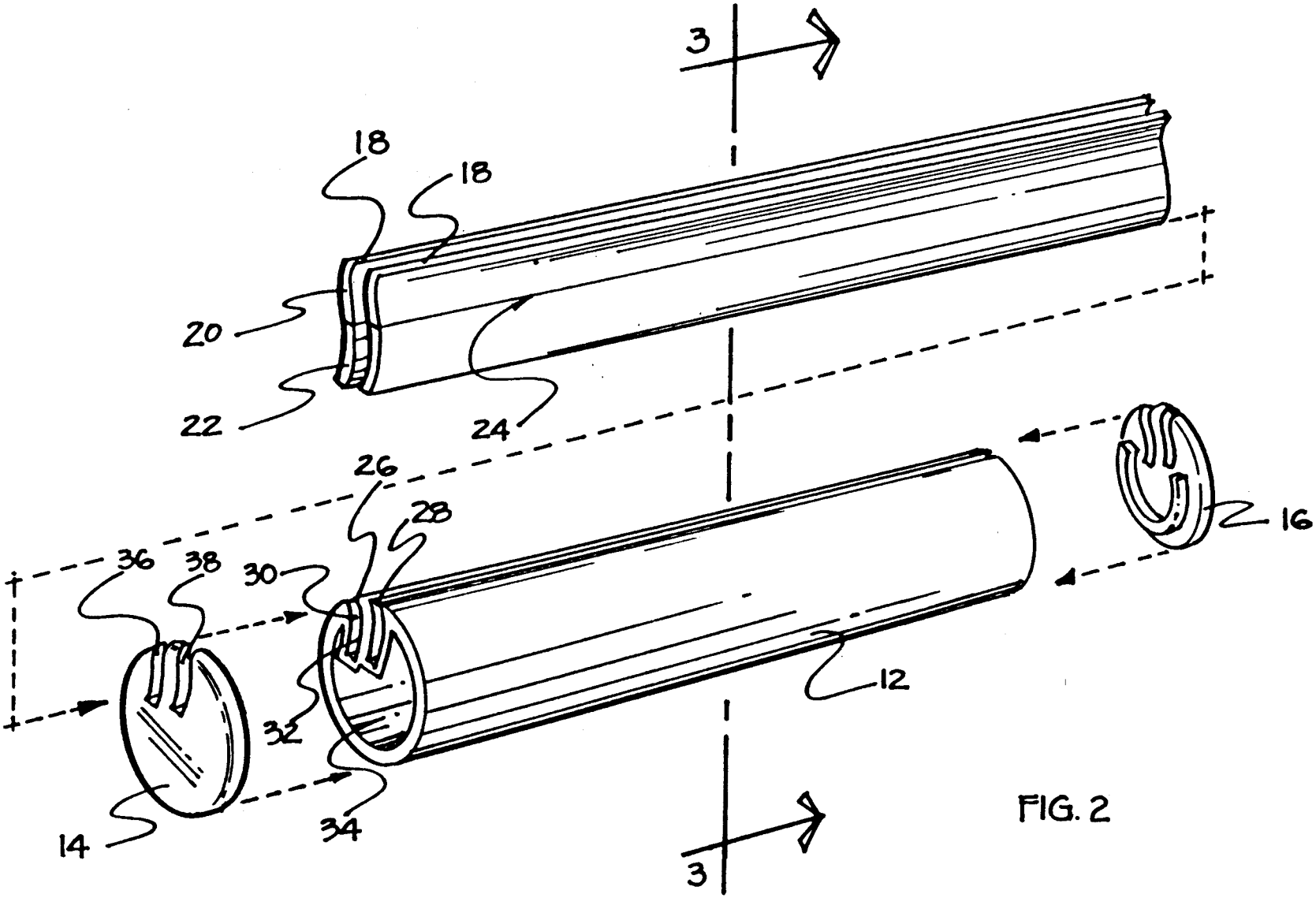
FIG. 2 is an exploded view showing details of construction and assembly of the squeegee of FIG. 1.
Figure 3:
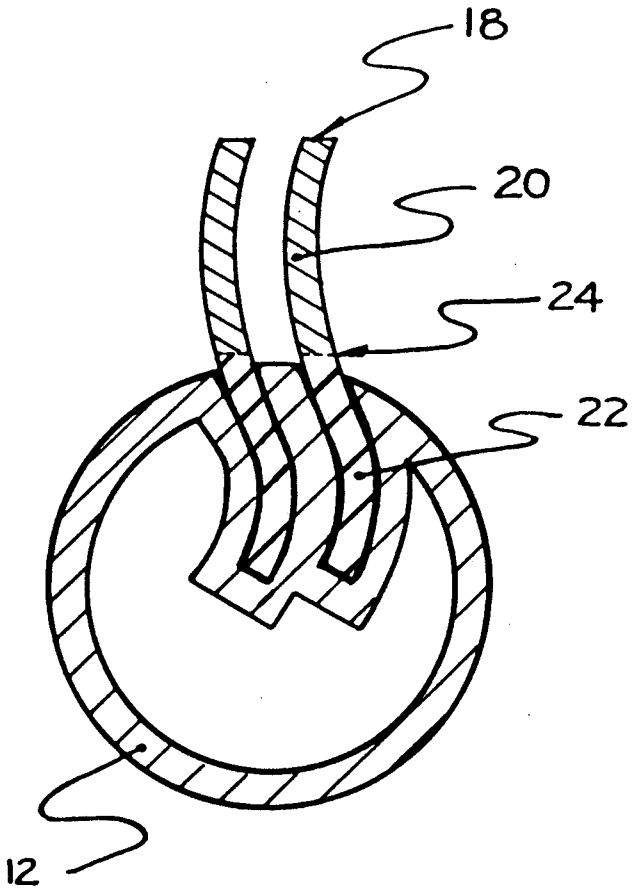
FIG. 3 is a cross-sectional view of the assembled squeegee, taken along lines 3—3 in FIG. 2.

Referring to FIGS. 2 and 3, the blades are integrally formed, preferably by coextrusion of polymeric materials of different hardness, in a shallow S-shaped cross-section. Coextrusion forms the blade as a composite polymeric structure with a first or base portion 22 composed of a substantially rigid polymeric material (e.g., polyvinyl chloride—Durometer 64-Shore D) for insertion lengthwise into the channels and a second portion 20 composed of a flexible polymeric material (e.g. PVC—Durometer 50—Shore A) for protruding from the channel openings to resiliently contact and conform to a nonflat surface to be cleaned by the squeegee. The flexible and rigid portions 20, 22 are integrally interconnected along interface 24.

The elongate tubular member that forms handle 12 is preferably formed by extrusion of a rigid polymeric material (e.g., Monsanto Santoprene—Durometer 73—Shore D). It is formed with a lengthwise extending groove that defines a pair of parallel channels 26, 28 spaced apart a predetermined distance circumferentially of the tubular handle. The parallel channels are formed with identical cross-sectional shapes to the same depths so that the blades have substantially aligned distal edges. Each of the channels is formed with parallel opposed sidewalls 30, 32 that are curved to conform to the curvature of the base portion 22 of each blade. The channels each have a base which is positioned to support the blades at a predetermined depth which approximately equals the width of the base portion of the blades. The bases of the channels are positioned to support the blades with their flexible, distal edges approximately equidistant from the handle. The channels are closely spaced but sufficiently apart that the blades do not interfere with one another when used.

The interior 34 of the tubular member is hollow and is enclosed by end caps 14, 16. The end caps are injection molded of a rigid polymer (e.g., rigid PVC) in mirror-image shapes with a semi-annular internal flange sized to fit inside the hollow portion to the tubular member and a pair of slots 36, 38 positioned and curved to align with the pair of channels.

In one example of a squeegee according to the invention, the cylindrical member that forms the handle has a length of 7.2 inches and a radius of 0.875 inch. The channels 26, 28 are spaced 0.2 inch apart and have sidewalls of 0.125 thickness spaced 0.125 inch apart. Along the bottom two-thirds of the channels, the inner sidewall 30 has a radius of 0.5 inch and the outer sidewall has a radius of 0.625 inch. Near the opening at the surface of handle 12, the curvature of the sidewalls gradually reverses, with a radius of 1.375 inch on wall 30 and 1.5 inch on wall 32. The blades 18 preferably have a length of 10 inches, a typical thickness of 0.125 inch and an overall width of 1.775 inches. The rigid portion 22 has a cross-sectional width of 0.875 and its opposite surfaces are curved at radii of 0.5 and 0.625 inch about a bisecting centerline spaced 0.35 from line 24. The flexible portion 20 has a width of 0.9 inch and its opposite surfaces are curved at radii of 1.5 and 1.375 inch about a bisecting centerline spaced 0.45 from line 24.

The method of the invention commences by forming the handle, blades and end caps as described above and shown in FIG. 2. The squeegee is then assembled by inserting each blade lengthwise into one of the channels, as indicated in FIG. 2. The curved base portion of each blade is arranged to form an interference fit in the radially curved channel. Being rigid lengthwise, however, the base portion retains the otherwise flexible blade substantially straight upon insertion into the channel.

In use, the squeegee is held by the person using it grasping the outside of the handle opposite the blades. The squeegee is positioned with the first end 14 near the butt of the user's hand and the second end, with protruding portions of the blades exposed, extending away, i.e., distally, from the user's body and hand for easy insertion into corners of a floor, wall or window surface. The squeegee is easily stored, e.g., in the corner of a tile bath, by standing it on flat end cap 14.

Optionally, the tubular member that forms handle 12 can be coextruded of soft and rigid materials to provide a soft handle for the user to grasp. Alternatively, the tubular member can be injection molded. As another option, end cap 16 can be formed with a thumb-actuable plunger on the end thereof. The plunger is connected to a conventional pump mechanism which extends into the hollow interior of the tubular member, so that a cleaning fluid can be supplied inside the squeegee and discharged upon actuation by the user from an outlet mounted between the blades.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A method of making a squeegee, comprising:

forming an elongate tubular member with a lengthwise extending groove of a predetermined width and depth having an opening in a sidewall of the tubular member;

forming a unitary blade of a predetermined length at least as great as the length of the tubular member and a width defining a base portion approximately equal in width to the depth of the groove and a flexible wiping portion of a predetermined width; and inserting the blade lengthwise into the groove;

the base portion being sized to a thickness sufficiently close to the width of the groove to form an interference fit in the groove and being rigid lengthwise such that the blade remains substantially straight upon insertion into the groove.

2. A method of making a squeegee according to claim 1 in which the elongate tubular member with lengthwise extending groove is formed by extrusion of a rigid polymeric material.

3. A method of making a squeegee according to claim 1 in which the unitary blade is formed by coextrusion of a rigid polymeric material to form the base portion and a soft polymeric material to form the wiping portion.

4. A method of making a squeegee according to claim 1 in which the elongate tubular member is formed with two parallel, spaced channels each defining one said lengthwise extending groove and one said blade is inserted lengthwise in each channel.

5. A method of making a squeegee according to claim 4 in which each blade is formed in a shallow S-shaped cross section and each groove is formed with parallel curved sidewalls conforming to a curvature of the base portion of the blade.

6. A method of making a squeegee according to claim 1 in which the blade is formed in a shallow S-shaped cross section and the groove is formed with parallel curved sidewalls conforming to a curvature of the base portion of the blade.

7. A method of making a squeegee according to claim 6 in which the unitary blade is formed by coextrusion of a rigid polymeric material to form the base portion and a soft polymeric material to form the wiping portion.

8. A method of making a squeegee according to claim 1 in which forming the elongate tubular member with lengthwise extending groove includes forming a pair of end caps sized and shaped to enclose opposite ends of the tube, the end caps each including a slot shaped to align with the groove.

* * * * *